US005921564A

United States Patent [19]

Olson

[11] Patent Number: 5,921,564

[45] Date of Patent: Jul. 13, 1999

[54] SNOW BOARD

[75] Inventor: Michael T. Olson, Seattle, Wash.

[73] Assignee: CSOC Holdings, Inc., Seattle, Wash.

[21] Appl. No.: 08/844,772

[22] Filed: Apr. 22, 1997

[51] Int. Cl.[6] ..... A63C 5/044

[52] U.S. Cl. ..... 280/14.2; 280/602; 280/609; 280/610

[58] Field of Search ..... 280/14.2, 602, 280/609, 610

[56] References Cited

U.S. PATENT DOCUMENTS

| | | | |
|---|---|---|---|
| 3,194,572 | 7/1965 | Fischer | 280/610 |
| 3,614,116 | 10/1971 | Haldeman | 280/610 |
| 3,698,731 | 10/1972 | Jost et al. | 280/610 |
| 4,077,652 | 3/1978 | McCaskey, Jr. et al. | 280/610 |
| 4,928,989 | 5/1990 | Mayr et al. | 280/610 |
| 4,974,868 | 12/1990 | Morris | 280/609 |
| 5,673,926 | 10/1997 | Gauer | 280/610 |

*Primary Examiner*—Charles T. Jordan
*Assistant Examiner*—Charles R Ducker, Jr.
*Attorney, Agent, or Firm*—Jensen & Puntigam, P.S.

[57] ABSTRACT

A snow board comprising a flexible core element enveloped by a covering of resin impregnated fiberglass wherein the core includes a plurality of parallel grooves running the longitudinal direction of the board such that in conjunction with resin impregnated fiberglass form a series of parallel integral hollow beam members increasing the strength of the board while simultaneously reducing the overall weight

3 Claims, 1 Drawing Sheet

SNOW BOARD

TECHNICAL FIELD

This invention relates to boards for recreational purposes, i.e., snow boards, wake boards, skateboards, skis or the like, and more particularly to an improved board which is lighter in weight and inherently stronger.

BACKGROUND OF THE INVENTION

It is well known that recreational boards such as snow boards, wake boards and the like have increased in popularity over the past several years. The use of these boards requires that they be lightweight for ease of transport, that they be strong to resist the flexural stresses presented to them by undulating supporting surfaces, and further, that they be resistant to penetration by water.

Structurally, the boards are fabricated of a lightweight core which may be of a lightweight wood or of a synthetic and wrapped in a waterproof envelope which is typically a resin impregnated fiberglass which adds color and design to the exterior surface of the board while at the same time providing a sealant to prevent the ingress of liquid. The resin impregnated fiberglass adds structural stability to the entire package by providing space to separate flexural members which allow a limited amount of compression thus increasing the integrity.

DISCLOSURE OF THE INVENTION

With the above-noted prior art in mind, it is an object of the present invention to provide a new improved recreational board which has superior strength and yet is lighter of weight.

Still another object of the present invention is to provide a recreational board which, although superior in strength, lighter in weight, is in fact lower in cost.

Still a further object of the present invention is to provide a recreational board which is fabricated of a wooden core which is relieved to provide slots in the bottom of the board which are then sealed with the fiberglass resin combination.

Still a further object of the present invention is to provide an improved recreational board wherein a plurality of parallel grooves are machined in the lower surface of the core and then sealed with a pre-impregnated fiberglass.

BEST MODE FOR CARRYING OUT THE INVENTION

Figure 1:
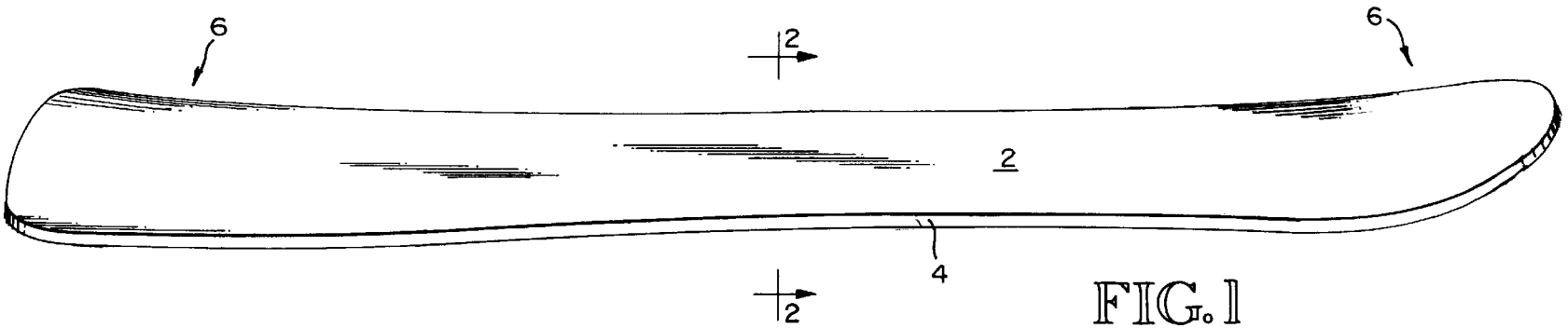
FIG. 1 PRIOR ART
FIG. 1 is a pictorial representation of a typical recreational board and in particular a snow board.

As seen in FIG. 1, the illustrative board which is a snow board has a top 2, edge 4 and an outwardly flared and upwardly turned end portion 6. The snow board bindings, not shown, are mounted to the upper portion and the board is ridden over the snow wherein the undulations cause an ongoing flexure of the material requiring both flexibility and strength. Since the board is ridden down the slope and carried back up the slope, it is desirable that it be as light a weight as possible, and yet within this requirement of being lightweight, it is necessary that the board be waterproof since it is always used in adverse conditions, and further, that it have sufficient strength and flexibility to withstand the constant change of profile, it being understood that as the board traverses the irregular snow surface, the end portions will move up and down as well as being subjected to twisting torque.

Figure 2:
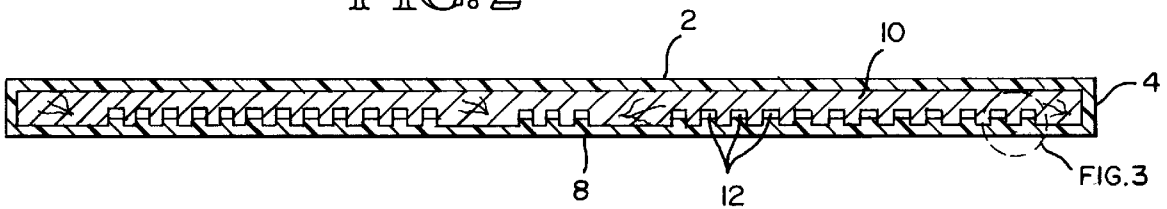
FIG. 2 is an enlarged cross section taken along lines 2—2 of FIG. 1.

Referring now to FIG. 2, a cross section along lines 2—2 of FIG. 1, it can be seen that the upper surface 2, the edges 4 and the bottom 8 all comprise a continuous sheet of resin impregnated fiberglass. The bottom surface which takes the maximum wear is comprised of 5/100 of an inch of polyethylene and 25/1000 of resin impregnated fiberglass matting. Also to be seen in this view is the fact that the exterior skin is wrapped around a core 10 which is preferably fabricated of a lightweight wood, although other materials could be used. Since the core 10 primarily serves as a support for the resin impregnated fiberglass it need not be of particularly great strength and can be soft since the strength is provided by the fiberglass skin which envelopes the core. Also to be seen in this view are a plurality of longitudinal slots 12 cut in the bottom surface of the board. The slots 12 are generally of uniform spacing but it is to be noted that there are two portions adjacent the longitudinal center of the board which are not slotted. These non-slotted portions are to receive the T-nuts which secure the bindings.

Figure 3:
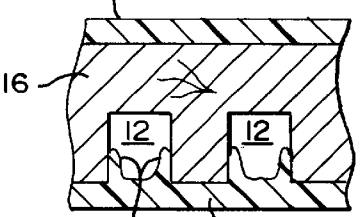
FIG. 3 is an enlarged portion taken at (FIG. 3) in FIG. 2.

Reference is now had to FIG. 3 wherein it can be seen that the slots 12 form openings which are bridged by the resin impregnated fiberglass forming the bottom surface 8.

The parallel longitudinal slots 12 are cut into the bottom surface of the core material 10 such that there is 6/100 of an inch of core at the top surface of the board. When the resin impregnated fiberglass is laid on the bottom of the board the resin wicks inwardly along the edges of the slots 12 forming a series of parallel ridges 14 which serve to increase the strength of the board.

Figure 4:
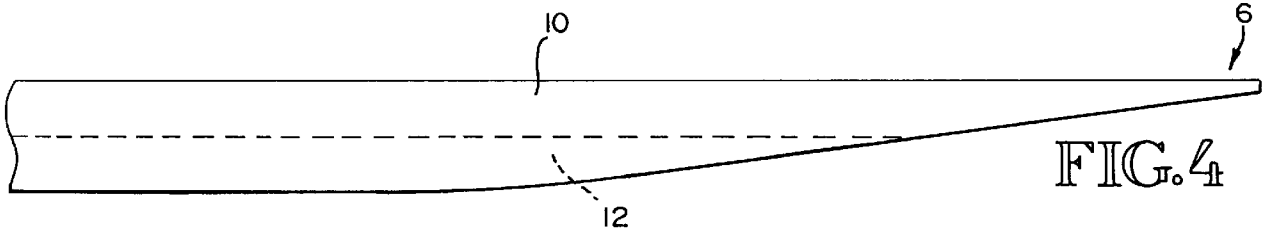
FIG. 4 is a side elevational view of the core of the board of FIG. 1.

Referring now to FIG. 4, it can be seen that the board, prior to being formed into an upwardly curved end portion is actually thin to the point where the ends are approximately 8/100 of an inch in thickness.

Thus, as can be seen, the present invention results in a lightweight, strong board which will maintain its strength along the upper surface wherein the breakage normally occurs.

Although a preferred embodiment of the invention has been disclosed herein for illustration, it should be understood that various changes, modifications and substitutions may be accorded in such embodiment without departing from the spirit of the invention, which is defined by the claims that follows.

What is claimed is:

1. A board for recreational use, comprising:

a flexible, fibrous, elongated core element enveloped by a covering of resin-impregnated fiberglass, wherein the core includes a smooth upper surface;

plurality of parallel grooves running the longitudinal direction of the lower surface of the core element, such that in conjunction with the resin-impregnated fiberglass form a series of parallel, integral, hollow beam members for increasing the strength of the board while simultaneously reducing the overall weight; and wherein the resin-impregnated fiberglass includes inwardly projecting longitudinal ridges adjacent the edges of the grooves.

2. A board as in claim 1, wherein the grooves leave an upper surface thickness of approximately 0.06 inches.

3. A method of manufacturing a composite board for recreational use, comprising:

cutting an elongated, wooden core element to the desired dimension;

forming a plurality of parallel grooves along the long dimension of the core; and enclosing the core with at least one layer of fiber-impregnated resin, such that the resin wicks inwardly along the edges of the grooves, forming parallel ridges thereby substantially increasing the strength of the board.

* * * * *